United States Patent [19]

Kauss

[11] Patent Number: 5,046,310

[45] Date of Patent: Sep. 10, 1991

[54] LOAD-INDEPENDENT CONTROL DEVICE FOR HYDRAULIC LOAD DEVICES

[75] Inventor: Wolfgang Kauss, Lohr/Wombach, Fed. Rep. of Germany

[73] Assignee: Mannesmann Rexroth GmbH, Lohr/Main, Fed. Rep. of Germany

[21] Appl. No.: 502,995

[22] Filed: Apr. 2, 1990

[30] Foreign Application Priority Data

Apr. 4, 1989 [DE] Fed. Rep. of Germany ..... 3910895

[51] Int. Cl.[5] ..... F15B 11/02

[52] U.S. Cl. ..... 60/468; 90/445; 90/447; 90/461

[58] Field of Search ..... 60/445, 468; 91/445, 91/46, 447, 461

[56] References Cited

U.S. PATENT DOCUMENTS 2,892,312 6/1959 Allen et al. ..... 60/468 X
4,711,155 12/1987 Brunner et al. ..... 91/446
4,967,554 11/1990 Kauss ..... 60/452

FOREIGN PATENT DOCUMENTS 2514624 10/1976 Fed. Rep. of Germany .
3206842 9/1983 Fed. Rep. of Germany .
3733677 4/1989 Fed. Rep. of Germany .
3733679 4/1989 Fed. Rep. of Germany .

*Primary Examiner*—Edward K. Look
*Assistant Examiner*—George Kapsalas
*Attorney, Agent, or Firm*—Burns, Doane, Swecker & Mathis

[57] ABSTRACT

A control device transmits hydraulic pressure from a continuously circulating pump to a hydraulic device. A pressure limiting valve communicates with the pump to exhaust the pump to reservoir when the system is in a stand-by mode. The control device includes a servo valve and a directional control valve. Movement of the latter relative to the former is possible in order to create a pressure back-up in a load indicating line which closes the pressure limiting valve, thereby increasing the pump pressure supplied to the servo valve when it is desired to initiate a working mode. Subsequent actuation of the servo valve causes hydraulic pressure to be supplied to or exhausted from the hydraulic device. Actuation of the servo valve is produced by hydraulic pressure which also communicates with the load indicating line via a one-way valve.

9 Claims, 1 Drawing Sheet

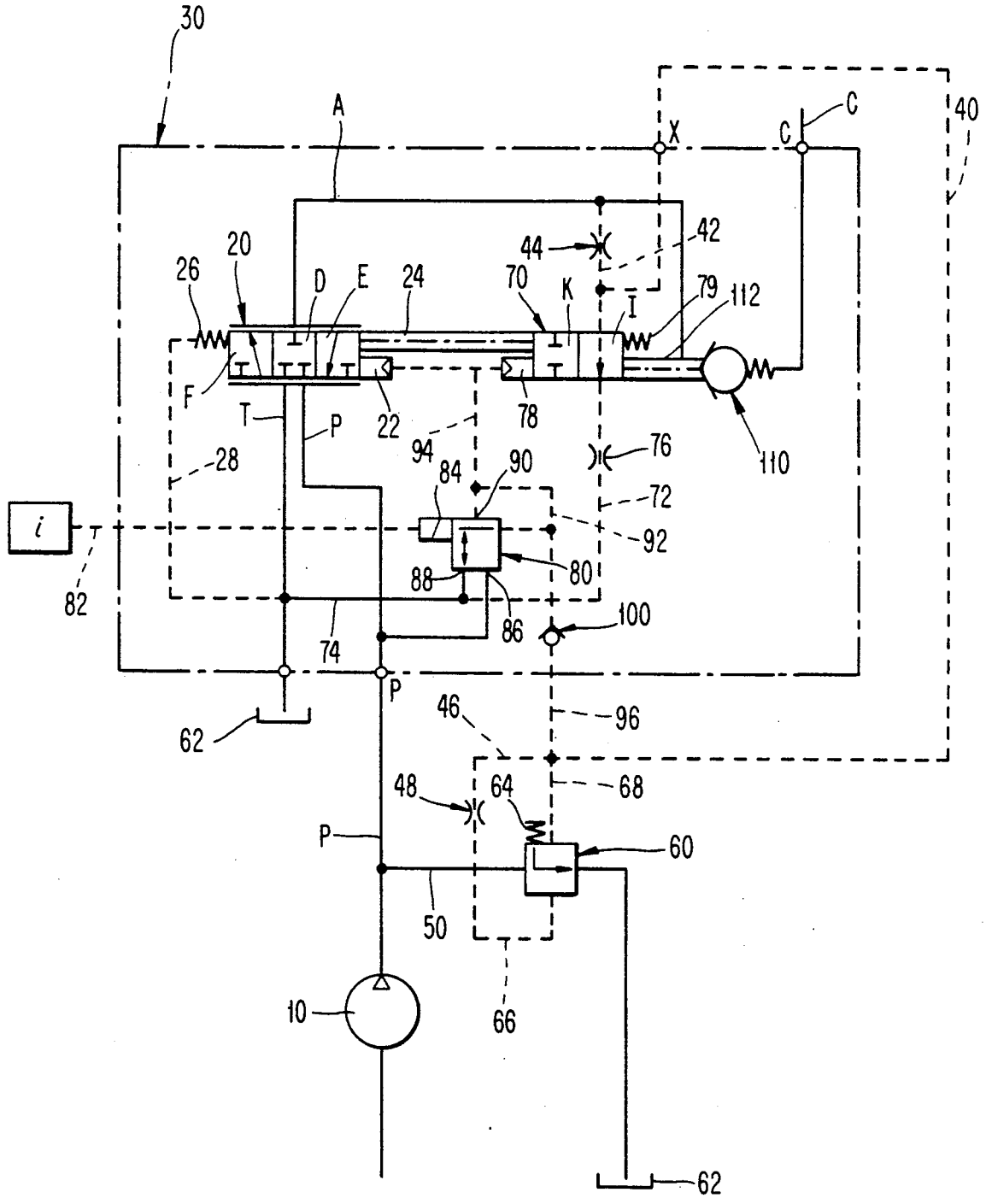
30
A
X
C
C
40
42
44
20
26
D
E
24
70
K
I
79
112
F
T
P
22
78
94
76
110
28
84
90
72
i
92
82
88
80
86
100
74
P
62
46
96
48
64
68
P
60
50
10
66
62

LOAD-INDEPENDENT CONTROL DEVICE FOR HYDRAULIC LOAD DEVICES

RELATED INVENTIONS

The invention disclosed herein is related to inventions disclosed in commonly assigned U.S. Pat. Nos. 4,967,554 and 4,960,035, as well as Ser. No. 502,988 filed concurrently herewith (priority of which is based upon German Application No. P 3911022.2. The disclosures of those applications are incorporated herein by reference.

BACKGROUND OF THE INVENTION

The invention relates to a load-independent control device for hydraulic users.

Described in German DE 25 14 624-A1 is a load-independent control device for hydraulic devices, comprising a control device for the hydraulic device and a directional control valve that can be controlled independently of the control unit. The directional valve has a through-position in which it conducts the load pressure to the reservoir, and a blocking position in which the load pressure is blocked from the reservoir. The control unit is brought from its neutral position into one of its operating positions by means of an external, separate actuator. At least one hydraulic device is connected to a pump via service lines. Through the pressure that then builds up in a sensor line, the directional control valve is moved into a blocking position in which it blocks the passage between a discharge pipe and a reflux line. Pressure control in the service lines takes place through a pressure regulating valve arranged upstream from the control unit.

Since the directional control valve can only occupy its blocking position when the control unit and the pressure regulating valve have assumed the volumetric flow regulating function, this results in a relatively sluggish response of the control device. This can have consequential effects particularly when a hydraulic system equipped with a control device of the type described above is switched from so-called stand-by mode to so-called load-sensing mode, in which a hydraulic quantity that is optimally adapted to the load of the work aggregate must be made available in a very short time, because an undersupply of the hydraulic aggregates can occur in the initial phase of volumetric flow regulation.

To counteract these disadvantages, there has been disclosed in the above-referenced U.S. Pat. No 4,967,554, a control device which ensures that the above-mentioned switching of the hydraulic system from a stand-by mode to a load-sensing mode is completed before the volumetric flow regulating function for the hydraulic consuming device is performed. As a result of the hydraulic operation of the directional control valve and the control unit (formed as a servo valve), it is possible to operate both elements of the control device with little expenditure and to ensure at the same time that the pump reliably provides a sufficiently high pressure when assuming volumetric flow regulation, even if the pump was previously operated at a very low energy level, for example in a stand-by mode.

The present invention aims to improve such a system as well as to adapt such a load-independent control device to hydraulic systems equipped with a fixed displacement pump, i.e., a pump with fixed stroke volume. In such volumetric flow regulated hydraulic systems with a fixed displacement pump, as low a pump circulation pressure as possible is strived for to reduce power losses in the neutral position of the hydraulic device and also when the load-sensing line is exhausted. If an internal control oil feed is provided, it can be assumed that the desired pump circulation pressure is clearly below the required control pressure.

The invention is, therefore, based on the task of developing a load-independent control device for hydraulic devices in such a way that it also can be used, with as little switching effort as possible, in a hydraulic system having a fixed-displacement pump, the pump circulation pressure of which is below the control pressure in the neutral position of the hydraulic device.

SUMMARY OF THE INVENTION

The present invention relates to a load-independent control device for conducting hydraulic fluid from a hydraulic pump to a hydraulic device. The pump preferably comprises a fixed-displacement pump. The pump supplies hydraulic fluid to a pump line. A pressure limiting valve, for the pump circulating pressure, communicates with the pump (preferably by being connected to the pump line) and is movable between a first position communicating the pump with a reservoir and a second position blocking communication of the pump with the reservoir. The control device comprises a servo valve movable from a neutral position to at least one working position for admitting hydraulic fluid from the pump line to a hydraulic device. A load indicating line communicates the pump with a control side of the pressure limiting valve and with the reservoir. A directional control valve is movable independently of the servo valve between a first position communicating the load indicating line with the reservoir, and a second position blocking communication between the load indicating line and the reservoir, whereby a pressure build-up in the control line moves the pressure limiting valve to its second position increasing the hydraulic pressure in the pump line. The servo valve and the directional control valve are movable in response to the application of hydraulic pressure thereto from a common pressure control line such that the directional control valve is moved to its second position before the servo valve is moved out of its neutral position. A pressure valve, preferably in the form of a pre-controlled pressure regulating valve, admits hydraulic fluid from the pump line to the common control pressure line for moving the servo valve and the directional control valve. The common control pressure line communicates with the load indicating line through a one-way valve.

Preferably, the pump line supplies the load indicating line via a throttle. Accordingly, after the pressure regulator has been actuated to pressurize the common control pressure line, it is assured that an immediate response of the pressure limiting valve will occur. The throttle contributes to the creation of a pressure differential between pump pressure and load indicating pressure required for volumetric load regulation, if the load indicating control line is connected to a consumer line via a further throttle.

Preferably, the directional control valve is movable to its second position at a lower pressure in the common control pressure line as compared to the pressure which causes the servo valve to move to its working position.

Preferably, the servo valve and the directional control valve comprise coaxially movable spool valves.

The spool valves are spring-biased toward one another by first and second springs which act against ends of the spool valves facing away from one another. The spool valves are operatively connected so that the spring forces are transmitted in opposition to one another. As a result, the servo valve is positioned in the neutral position when pressure in the common control pressure line falls below a preselected value.

Preferably, the servo valve admits hydraulic fluid from the pump line to a service line. The service line includes a blocking valve which opens to admit hydraulic fluid to the hydraulic device. A releasing piston is arranged to be displaced in order to open the blocking valve in response to movement of the directional control valve to the second position. This enables the service line to be hermetically sealed until the servo valve is shifted to a working position.

The pressure regulator preferably comprises an electrically actuated pressure regulating valve. The energy level of the control signal which actuates the pressure regulator is independent of the pump circulation pressure and thus the latter can be kept at an optimally low value.

BRIEF DESCRIPTION OF THE DRAWING

The objects and advantages of the invention will become apparent from the following detailed description of a preferred embodiment thereof in connection with the accompanying drawing in which like numerals designate like elements. The sole FIGURE schematically depicts a hydraulic circuit fed by a fixed-displacement pump, into which circuit a load-independent control device for a hydraulic device is incorporated.

DETAILED DESCRIPTION OF A PREFERRED EMBODIMENT OF THE INVENTION

In the illustration, reference numeral 10 designates a fixed-displacement pump, for example a geared pump, that feeds a service line A, C with hydraulic fluid via a pump line P. Feeding of the service line A takes place via a 4/3 servo valve 20 which is shown in its centered neutral or blocking position D in which it closes a tank line T leading to a reservoir 62. The 4/3 servo valve 20 is a component of a valve unit 30 that has the purpose of providing for an intermittent supplying of the hydraulic device and, to that end carries out a switching function and a volumetric flow regulating function adapted to the hydraulic flow needs of the hydraulic device.

For this purpose a load indicating line or control line 40 carrying the load pressure is provided that is in connection with the service line A via a control line section 42 in which a first throttle 44 is arranged, and is also in connection with a pump branch line 50 via a further control line section 46 in which a second throttle 48 is arranged. The pump branch line 50 can be exhausted to the reservoir 62 via a pressure limiting valve 60 whereby the pump circulation pressure can be regulated in the stand-by mode of the hydraulic system via the power of a valve spring 64. The initial force of the valve spring 64 is chosen as low as possible with a view to minimizing circulation losses in such a way that the pressure limiting valve 60 is already brought into the through or in-line position for exhausting the pump pressure at very slight pressures in the pump branch line 50 and a control line 66 branching from it. The force of the valve spring 64 can be supplemented by the pressure in the load indicating line 40 via a further control branch line 68. The pressure in lines 66 and 68 is at a minimum level in the illustrated initial position of the control device, since a connection of the control line 40 to the reservoir 62 is created by a position I of a 2/2 directional control valve 70 via a line branch 72 and a discharge line 74.

An electrically pre-controlled servo pressure valve is provided which is preferably formed as a conventional pressure regulating valve 80. Control of the pressure regulating valve 80 is effected by an electric actuator i via an electrical control line 82 that acts upon a control element 84. The pressure regulating valve 80 has: (i) an entry connection 86 fed by the pump line P, (ii) a discharge connection 88 connected with the discharge line 74, and (iii) an exit connection 90 that communicates with a control pressure line 94 which conducts a common fluid control pressure for the servo valve 20 and directional control valve 70. A return line 92 conducts the control pressure to a side of the valve 80 opposite the control element 84.

In the illustrated neutral position of the control device, the control signal from the actuator i is at such a level that the control pressure in the control line 94 is below a response threshold for the valves 20 and 70 which are spool-type valves. The pump 10 operates in this operating condition in so-called stand-by, in which the pump circulation pressure is kept to a minimum.

If one or more hydraulic devices are to be supplied with hydraulic fluid, wherein the supplied fluid is to have its volume regulated, the control signal from actuator i to the pressure valve 80 is raised, thus enlarging the passage between the entry connection 86 and the outlet connection 90. The control pressure line 94 is connected to the load-indicating line 40 by way of a connecting line 96. In this connection line 96, there is provided a one-way or back-pressure valve 100 which opens to conduct fluid toward the load-indicating line 40. If the passage between 86 and 90 is thus opened hydraulic fluid is conducted via the connecting line 96 into the control branch line 68 of the pressure limiting valve 60. So that this hydraulic fluid does not flow off immediately via the load indicating line 40 and the line branch 72 to the reservoir 62, a throttle 76 is provided in the line branch 72. Thus, the pressure limiting valve 60 is closed whereupon the pressure in the pump line P and the branch line 50 increases. By raising the pump pressure in the pump line P the pressure in the common control pressure line 94 is raised high enough to initiate the switching and control function of the valve unit 30.

As can be seen from the illustration, the pressure in the control pressure line 94 is applied to a control element 78 of the directional control valve 70 and, at the same time, to a control element 22 of the servo valve 20. The control surface of the control element 78 is larger than the control surface of the control element 22. Consequently, when pressure builds up in the control pressure line 94, first the directional control valve 70 is moved from the through-position I into a blocking position K in which the connection of the load indicating line 40 to the tank 62 is blocked. That shifting takes place against the force of a return spring 79.

Normally, the spring 79 applies a bias to the directional control valve, which bias is transmitted to the servo valve 20 by means of a connector, e.g., in the form of a rod 24 interposed between the spools of those two valves. (Such a rod is disclosed in afore-mentioned U.S. Ser. No. 07/247,863.) The thus-transmitted bias is opposed by a bias from a spring 26 which acts against the spool of the servo valve 20. In the absence of a pressure in the control pressure line 94, the opposing biases of springs 79, 26 keep the valves 70, 20 in their positions I, D, respectively. The spool of the servovalve 20 thus is being mechanically centered by the springs 26 and 59. The rod 24 does not prevent movement of the directional control valve 70 away from the servo valve 20 (e.g., the rod could be connected to one of the valves 70, 26 but not to the other, or to neither of the valves). The side of the servo valve 20 facing the restoring spring 26 is connected with the reservoir 62 via a control line 28.

After locking-in the reservoir connection of the load-indicating line 40, i.e., after shifting the directional control valve 70 into the switching position K, the volumetric flow regulating function of the control device is performed. The continuous differential pressure required for this regulating in the service line A is maintained with the help of the two throttles 48 and 44. Before causing the servo valve 20 to assume position F, the pressure in the control pressure line 94 is raised by the appropriate actuation of the pressure regulating valve 80 to be high enough for the force acting through the control element 22 to counterbalance the force of the spring 26. As a result, when the directional control valve 70 is moved to position K, but the servo valve 20 remains in the closed or neutral position D.

By then manipulating the actuator i to reduce the control pressure in the control pressure line 94, the servo valve 20 can assume the left working position F under the force of the spring 26. The thus reduced control pressure is selected to be high enough so that the directional control valve 70 is held in the closed position K by the action of the control pressure on the control element 78.

If the pressure in the control pressure line 94 is increased rather than decreased, the servo valve 20 can be moved into the other, right-working position E.

It is thus possible, while maintaining a separation of switching and volumetric flow regulating functions of the control device, to control the valves 70 and 20 with a single control signal from a common control pressure line. There is preferably a coordination of the spring tensions and the effective surfaces of the control elements 22 and 78 in such a way that an equally large control pressure range is provided in both work positions E and F. Thus, for a total control pressure range of between 0 and 20 bar, for example, the coordination can be such that at 5 bar, for example, the directional control valve 70 assumes the blocking position K. At 12.5 bar, the control pressure is established with which the valve piston of the servo valve 20 is held in the neutral position D. A control pressure range of between 5 bar and 12.5 bar is thereby reserved for the operating position F of the servo valve 20 for volumetric flow regulating, whereas the control pressure range between 12.5 bar and 20 bar is intended for the operating position E of the servo valve 20.

The valve unit consisting of servo valve 20 and 2/2 directional control valve 70 is additionally coupled with a blocking valve 110. The directional control valve 70 shifts a tappet 112 by way of which the ball of the blocking valve can be lifted from the valve seat when the directional control valve 70 is displaced. The service line sections A and C are then connected with one another. In the stand-by condition a hermetic locking of the service line C takes place via the S closed blocking valve 110, and the service line can in this case be led to a hydraulic cylinder about which it must be ensured that it is not subject to any leaking under stress.

From the above it is clear that the load-independent control device for hydraulic devices according to the present invention is able, with little switching effort, to switch between a stand-by mode with minimized pump circulation pressure and an operational mode in which a volumetric flow regulated feeding of the consuming device takes place. By connecting the common control pressure line for the servo valve, on the one hand, and the directional control valve on the other hand, the pump circulation pressure can be kept lower in stand-by than the control pressure required to actuate the directional control valve. The volumetric flow regulating function takes place by varying the control signal of a the pressure regulating valve. Instead of actuating the pressure regulating valve 80 by an electrical signal, such actuation could be made by a hydraulic signal.

The invention thus creates a load-independent control device for hydraulic consuming devices, that is equipped with a control unit for the consuming device and a directional control valve that can be controlled independently of the control unit. The directional control valve has a blocking position as well as a through-position in which a control line guiding the load pressure is connected to the reservoir. The control unit is formed as a servo valve that is switchable along with the directional control valve via a common control line from the same control source. To prepare the transition from stand-by to the flow regulating function with a rapid response feature, the directional control valve is controlled in such a way that it is switched from the through-position into a blocking position before the servo valve is opened. To minimize the pump circulation losses in the stand-by mode of a continuous-action pump, the common control pressure line is fed via a pre-controlled servo pressure valve from the pump pressure and is connected via a back-pressure valve to the load pressure control line guiding the load pressure, which control line is in connection with the control side of a pressure limiting valve for the pump circulation pressure.

Although the present invention has been described in connection with a preferred embodiment thereof, it will be appreciated by those skilled in the art that additions, substitutions, modifications, and deletions not specifically described may be made without departing from the spirit and scope of the invention as defined in the appended claims.

What is claimed is:

1. A load-independent control device for conducting hydraulic fluid from a hydraulic pump to a hydraulic device, said pump supplying hydraulic fluid to a pump line, a pressure limiting valve communicating with said pump and being movable between a first position communicating said pump with a reservoir and a second position blocking communication between said pump and said reservoir, said control device comprising:

a servo valve movable from a neutral position to at least one working position for admitting hydraulic fluid from said pump line to the hydraulic device, a load indicating line for communicating said pump with a control side of said pressure limiting valve and with said reservoir, a directional control valve movable independently of said servo valve between a first position communicating said load indicating line with said reservoir, and a second position blocking communication between said load indicating line and said reservoir, whereby a pressure build-up in said load indicating line moves said pressure limiting valve to its second position increasing the hydraulic pressure in said pump line, said servo valve and said directional control valve being movable in response to the application of hydraulic pressure thereto from a common control pressure line such that said directional control valve is moved to its second position before said servo valve is moved out of its neutral position, and pressure valve means for admitting hydraulic fluid from said pump line to said common control pressure line for moving said servo valve and said directional control valve, said common control pressure line communicating with said load indicating line through a one-way valve.

2. A control device according to claim 1, wherein said load indicating line is supplied by said pump line via a throttle.

3. A control device according to claim 1, wherein said servo valve admits hydraulic fluid from said pump line to a service line, said load indicating line communicating with said service line.

4. A control device according to claim 1, wherein said directional control valve is movable to its second position at a pressure in said common control pressure line which is lower than the pressure causing said servo valve to move to said working position.

5. A control device according to claim 1, wherein said servo valve and said directional control valve comprise coaxially movable spools.

6. A control device according to claim 5, wherein said spools are spring-biased toward one another by first and second springs which act against ends of said spools facing away from one another, means disposed between said spools for transmitting the forces of said springs in opposition to one another, said springs being arranged to position said servo valve in said neutral position when pressure in said common control pressure line falls below a preselected value.

7. A control device according to claim 5, wherein said servo valve admits hydraulic fluid from said pump line to a service line, said service line including a blocking valve which opens to admit hydraulic fluid to the hydraulic device, and a releasing tappet arranged to be displaced to open said blocking valve in response to movement of said directional control valve to said second position.

8. A control device according to claim 1, wherein said pressure valve means comprises an electrically actuated pressure regulating valve.

9. A control device according to claim 1, wherein said pump comprises a fixed-displacement pump.

* * * * *